United States Patent [19]

Schonbach

[11] Patent Number: 4,694,997

[45] Date of Patent: Sep. 22, 1987

[54] APPARATUS FOR EXERTING A DOWNWARD FORCE ON A GRINDING ROLLER

[75] Inventor: Bernard H. Schonbach, Allentown, Pa.

[73] Assignee: Fuller Company, Bethlehem, Pa.

[21] Appl. No.: 808,324

[22] Filed: Dec. 12, 1985

[51] Int. Cl.[4] ..... B02C 15/00

[52] U.S. Cl. ..... 241/117; 241/285 B

[58] Field of Search ..... 241/107, 110, 117–120, 241/285 R, 285 A, 285 B

[56] References Cited

U.S. PATENT DOCUMENTS 4,432,500 2/1984 Brundiek et al. ..... 241/121 X

FOREIGN PATENT DOCUMENTS 2128929 6/1971 Fed. Rep. of Germany ..... 241/110

*Primary Examiner*—Timothy V. Eley

*Attorney, Agent, or Firm*—Frank H. Thomson

[57] ABSTRACT

An improved mechanism for exerting a downward force on a roller mechanism of a roller mill which includes a fluid actuated piston-cylinder device connected to the rocker arm of the roller by means of a link element pivotally connected at its one end to the piston-cylinder means and pivotally connected at its other end to the rocker arm.

4 Claims, 6 Drawing Figures

APPARATUS FOR EXERTING A DOWNWARD FORCE ON A GRINDING ROLLER

BACKGROUND OF THE INVENTION

This invention relates to vertical roller mills of the type which include a rotating grinding table and grinding rollers which cooperate with the grinding table for comminuting material therebetween. More particularly, the invention relates to an improved apparatus for exerting a downward force on the grinding roller.

Prior to the present invention, roller mills of the type to which the present invention relates were known. These mills are particularly suitable for comminuting material such as coal, limestone, and cement raw meal. These roller mills include a generally horizontal grinding table rotated by a motor with at least one and preferably between two and four grinding rollers mounted at an angle to the grinding table for rotation about their own axis. The mill will include a mill body with a classifier mounted at the top. Material is supplied to the grinding table for comminution between the grinding table and the roller. A downward force is exerted on the grinding roller to crush or comminute material between the roller and the table. Air is passed through the mill and entrains the fine material and lifts the same to the classifier. The coarse fraction is returned to the mill and the fine fraction exits the mill with the vent air to a gas solids separator were product is collected. Example of this type of roller mill are shown in U.S. Pat. Nos. 4,339,080; 4,235,385; and 4,432,500.

A typical roller mill will have the grinding roller connected to a rocker arm which is pivotal relative to the mill body about a central point. Downward force is exerted on the grinding roller by exerting a force on the rocker arm tending to rotate the rocker arm and hence the grinding roller relative to the grinding table about the central pivot point. With prior practice, the means for exerting a force on the rocker arm includes a hydraulic piston-cylinder arrangement with the piston means directly connected to the rocker arm. The connection may be made through a spring element. Material between the table and roller will vary in depth and cause the grinding roller to be in a state of steady upward and downward movement. This movement will be transferred through the rocker arm to the piston-cylinder means. With prior practice, the connection between the piston means and the rocker arm is such that movement of the grinding roller and rocker arm tends to cause the piston to bind against the cylinder causing excessive wear on the piston and cylinder. In addition, the movement of the rocker arm is insufficient to cause adequate relative movement of the pivotal connection between the rocker arm and the piston so that bearings tend to have excessive wear.

The present invention may also be used in connection with any device where it is desired to exert a downward force on a member.

SUMMARY

It is the principal object of the invention to provide an improved mechanism for exerting a downward force on a member.

It is a further object of this invention to provide an improved means for exerting a downward force on the grinding roller of a roller mill to provide improved wear life to the apparatus.

The foregoing and other objects will be carried out by providing in a roller mill for comminuting solid material including a generally horizontal grinding table mounted for rotation about its own axis, at least one grinding roller mounted at an angle to the grinding table for rotation about its own axis for cooperation with the grinding table for comminuting material between the grinding table and the grinding roller, a rocker arm mounted for pivotal movement relative to said grinding table, said grinding roller being mounted on one end of a rocker arm, an improved apparatus for exerting a downward force on the grinding roller comprising piston-cylinder means including a piston and an upwardly extending shaft, a link element pivotally connected at its one end to said shaft and pivotally connected at its other end to said rocker arm whereby downward movement of said piston causes said rocker arm to pivot and exert downward force on the grinding roller.

Briefly stated, the means for exerting a downward force includes a fluid actuated piston cylinder apparatus with the cylinder fixed in the housing of the mill. The piston includes a shaft which is connected to the rocker of the grinding roller by means of a link. This link is pivotally connected at its one end to the shaft of the piston cylincer means and pivotally connected at its other end to the rocker arm. When a downward force is exerted on the piston means, this downward force is transferred through the link to the pivotally mounted rocker arm and hence to the grinding roller.

BRIEF DESCRIPTION OF DRAWINGS

The invention will be described in connection with the annexed drawings wherein.

DESCRIPTION OF THE PREFERRED EMBODIMENT

Figure 1:
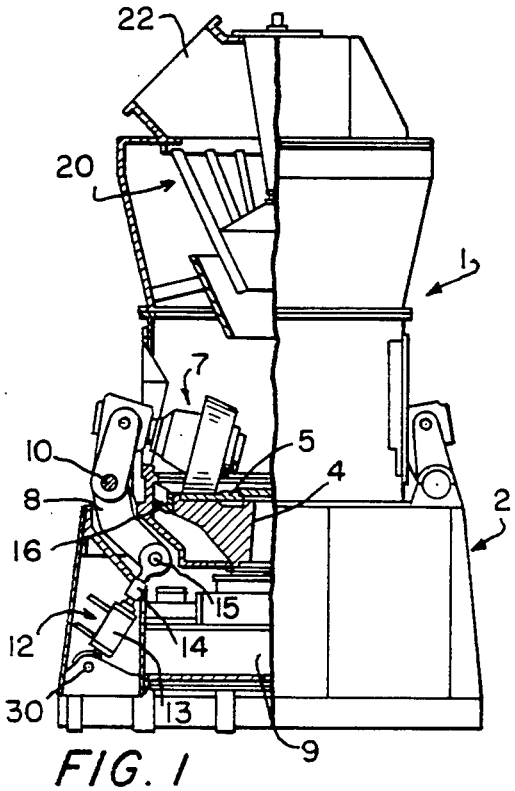
FIG. 1 PRIOR ART
FIG. 1 is a diagrammatic view of a roller mill according to the prior art.

Referring to the drawings and in particular to FIG. 1, there is shown a roller mill generally known in the art including a mill body indicated at 1 which is supported by a frame 2. A generally horizontal grinding table 4 is mounted for rotation about its own vertical axiswithin the body 1 and frame 2 and has a table liner 5 mounted thereon. A suitable motor (not shown) is provided for rotating the table 4 through a gear reducer means 9, known in the art. The roller mill includes a roller assembly generally indicated at 7 mounted on a rocker arm 8 which is pivotally mounted on the frame at 10 for movement relative to the table 4. The apparatus also includes a means 12 for exerting a downward force on the rocker arm 8. This means is typically a hydraulic piston-cylinder apparatus 13 including a shaft 14 connected at 15 to the rocker arm 8. Downward movement of the shaft 14 causes the rocker arm 8 to pivot about point 10 and exert a downward force on roller means 7 so that material between the liner 5 and roller 7 will be comminuted as the table is rotated.

In accordance with prior roller mills, air is supplied to the housing for passage through the housing through an inlet (not shown) for passage through louver ring 16 to entrain fine material and lift it to a classifier generally indicated at 20. Coarse material is separated from the fine fraction in the classifier and returned to the grinding table for further comminution. Fine material is discharged through an outlet 22 to a gas-solids separator such as a high efficiency dust collector for separation as product.

Figure 2:
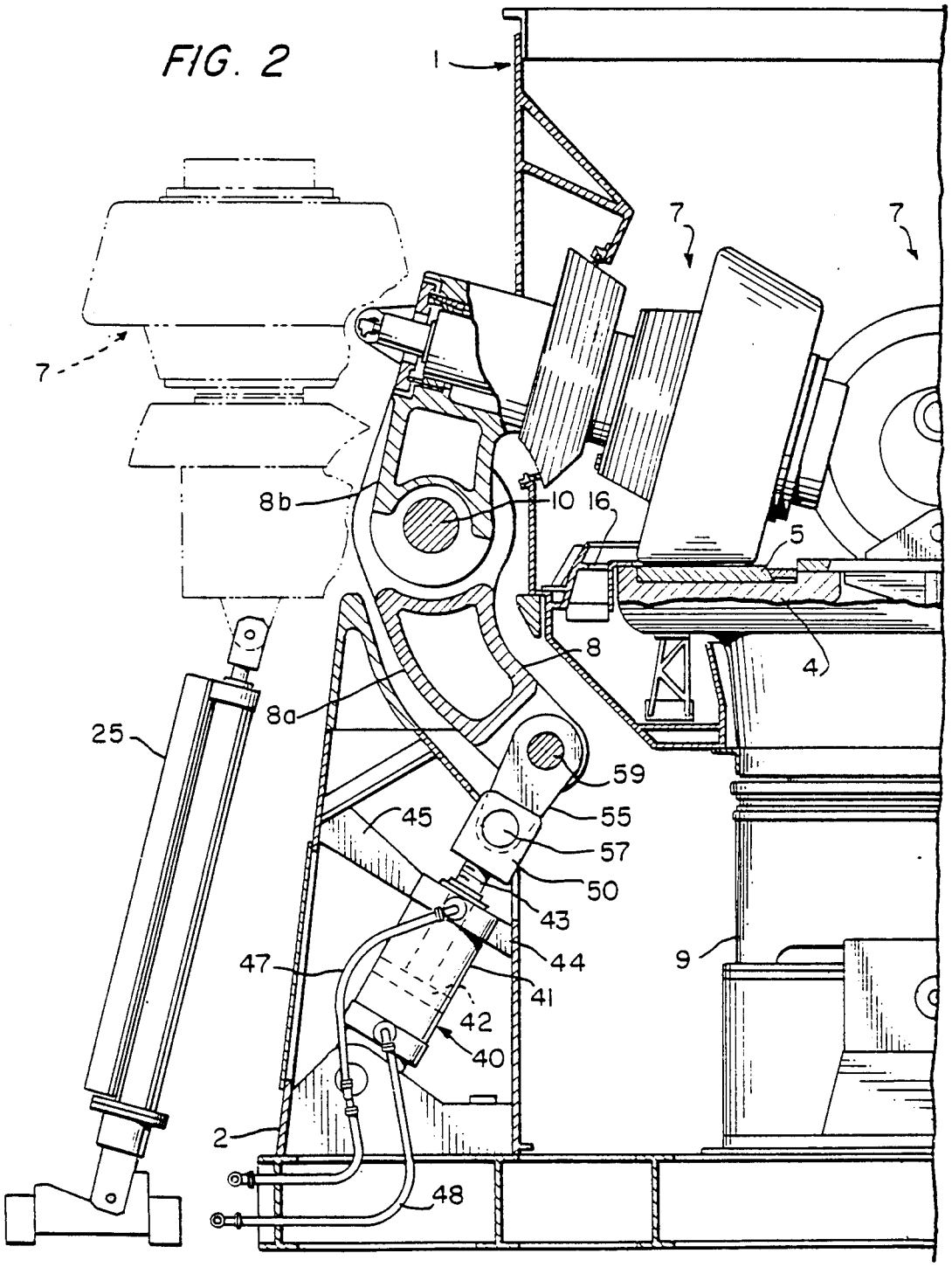
FIG. 2 is a diagrammatic view of a portion of a grinding mill utilizing the present invention.

As is shown in FIG. 2, the rocker arm 8 may be divided into a lower half 8*a* in the form of a fork section and an upper half 8*b* with the roller assembly 7 secured to the upperhalf. During operation of the mill, the upper half 8*b* is pinned to the lower fork 8*a* to form a unitary rocker arm 8. When it is desired to service the roller assembly 7, the upper half 8*b* can be disconnected from the lower half 8*a* to permit the upper half 8*b* of the rocker arm 8 and the roller mechanism 7 to be pivoted out of the mill body 1 by means of a piston-cylinder means 25 from the position shown in solid lines to the position shown by broken lines. This mechanism is shown in further detail in U.S. Pat. No. 4,432,500 issued Feb. 21, 1984.

Figure 5:
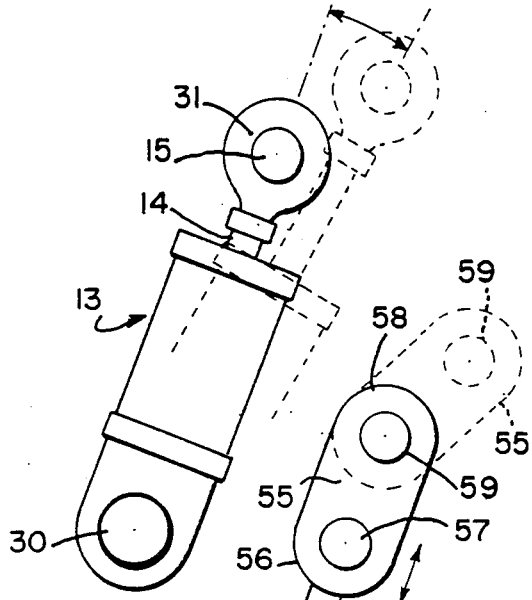
FIG. 5 PRIOR ART
FIG. 5 is a diagrammatic view of the motion of the prior art.

According to the prior practice, the piston cylinder means 13 shown in FIG. 1 and in FIG. 5 includes a hydraulically actuated cylinder 13 which is pivotally connected at 30 to the frame 2. This piston-cylinder means includes a shaft 14 with an eye 31 which is adapted to be directly conntected to the rocker arm 8 by means of a pivot pin 15. Hydraulic fluid is supplied to the cylinder 13 to exert a downward force on the shaft 14 to exert a downward force on roller 7 to comminute material between the roller and the table. As the depth of material on the table increases and decreases, there will be upward and downward movement of the roller assembly which is transferred through the rocker arm 8 to the piston shaft 14. This force will tend to cause the cylinder means 13 to pivot about the connection 30, but the pivotal action of the rocker arm 8 will not result in a straight line movement of the piston shaft 14 relative to cylinder 13 and will cause the piston 14 to bind against the cylinder 13. While there may be some rotation of the connection 15 relative to the eye 31 (FIG. 5), the movement will be so small that the bearing connection between point 15 and eye 31 will have excessive wear due to the lack of lubricant being able to work between the various parts.

According to the present invention, the piston-cylinder 13 of the prior art has been replaced by the piston-cylinder means 40 (FIGS. 2 to 4 and 6) including a cylinder 41 and a piston 42 mounted for movement therein including a shaft 43 extending out of the cylinder. The cylinder will include hydraulic fluid supply line 47 and 48 on opposite ends of the cylinder 41 and connected to a suitable source of pressure such as a pump (not shown) to provide a means for moving piston 42 and shaft 43. The piston-cylinder means 40 is fixed by means of brackets 44 and 45 within the housing 1. Thus, the pivotal connection at 30 in the prior art has been replaced by a fixed connection 46 thereby eliminating the need for a bearing.

Figure 3:
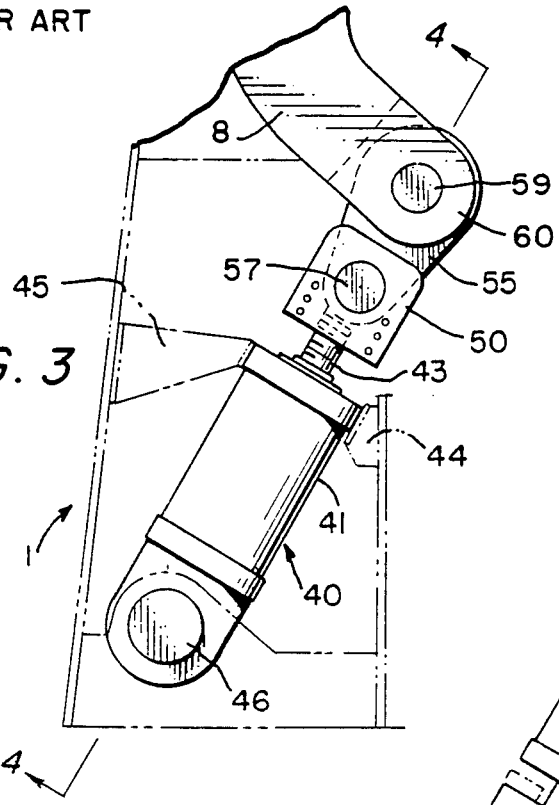
FIG. 3 is a view of the link connection of the present invention.
Figure 4:
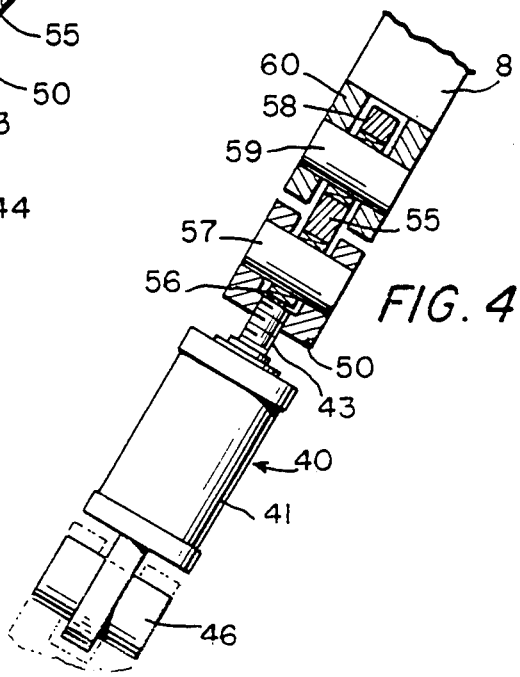
FIG. 4 is a sectional view taken on the line 4—4 of FIG. 3.

As shown in FIGS. 2 and 4, the piston 43 has a clevis 50 mounted thereon. A link element 55 is pivotally connected at its one end 56 to the clevis 50 by means of a pin 57. The link element 55 is pivotally connected at its other end 58 by means of a pin 59 to a clevis 60 which forms part of the rocker arm 8. In the normal position as illustrated in FIGS. 2 and 3, the pivot point 57 is substantially aligned with the point 59 and the shaft 43.

If desired, the clevis 50 may include spring means for absorbing minor movement of the rocker arm 8.

Figure 6:
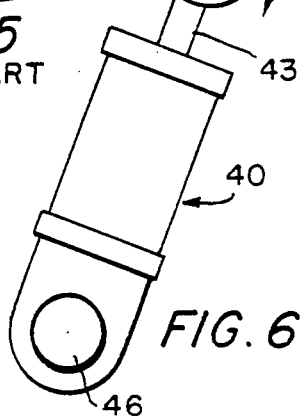
FIG. 6 is a view similar to FIG. 5 showing the present invention.

Referring to FIG. 6, it will be seen that movement of the shaft 43 caused by upward movement of the roller assembly 7 will result in the link member moving from the position shown in solid lines to the position shown in phantom. While this movement is exaggerated in FIG. 6 for purposes of clarity, it will be seen by comparing FIGS. 5 and 6 that the link member 55 rotates at the connections 57 and 59 a greater amount than the connection between eye 31 and pin 15. This means that bearings at pins 57 and 59 will have greater movement allowing lubricant to enter the area between the pin 59 or 57 and the link element 55. This movement will improve the bearing life. In addition, because of the pivotal connection at 57 and 59, there will be straight line movement of the shaft 43 and piston means 42 within the cylinder 41. This means that there will less wear on the piston-cylinder means 40 than is experienced with the prior art.

From the foregoing, it should be apparent that the objects of this invention have been carried out. The present invention has several advantages over prior practice including a higher degree of motion in the bearings at the connection of the piston-cylinder means to the rocker arm which allows for bearing roller overlap and better lubrication. Because two bearings are utilized at 57 and 59, there is load sharing which lowers the applied load to each bearing and increases life. The present invention also permits the cylinder means 40 to be fixed so that flexible connections of hydraulic fluid and the piston-cylinder means are no longer required. The fixed cylinder 40 requires no bearing at the bottom connection.

It is intended that the foregoing is merely a description of the preferred embodiment and that the invention be limited solely which is within the scope of the appended claims.

What is claimed is:

1. In a roller mill for comminuting solid material including a generally horizontal grinding table mounted for rotation about its own axis, at least one grinding roller mounted at an angle to the grinding table for rotation about its own axis for cooperation with the grinding table for comminuting material between the grinding table and the grinding roller, a rocker arm mounted for pivotal movement relative to said grinding table, said grinding roller being mounted on one end of said rocker arm, an improved apparatus for exerting a downward force on the grinding roller comprising piston-cylinder means including a piston and an upwardly extending shaft, a link element pivotally connected at its one end to said shaft and pivotally connected at its other end to the other end of said rocker arm whereby downward movement of said piston causes said rocker arm to pivot and exert downward force on the grinding roller.

2. In a roller mill for comminuting solid material according to claim 1, said shaft and said other end of said rocker arm each having a clevis mounted thereon and said link element is pivotally connected to said piston and to said rocker arm through said clevises.

3. In a roller mill for comminuting solid material according to claim 1 wherein said piston-cylinder means includes a fixed cylinder and means for supplying fluid to said cylinder for exerting a downward force on said piston.

4. In a roller mill for comminuting solid material according to claim 1 wherein said pivotal connection at said one end is substantially aligned with the pivotal connection at said other end and said shaft during normal operation of the mill.

* * * * *